US006585626B2

(12) United States Patent
McBride

(10) Patent No.: US 6,585,626 B2
(45) Date of Patent: Jul. 1, 2003

(54) BENCH EXERCISER WITH UPWARDLY DIVERGING BUNGEE CORD SUPPORTS

(75) Inventor: Robert W. McBride, Springfield, MO (US)

(73) Assignee: Stamina Products, Inc., Springfield, MO (US)

( * ) Notice: Subject to any disclaimer, the term of this patent is extended or adjusted under 35 U.S.C. 154(b) by 0 days.

(21) Appl. No.: 09/737,548

(22) Filed: Dec. 18, 2000

(65) Prior Publication Data

US 2002/0077228 A1 Jun. 20, 2002

(51) Int. Cl.[7] ..... A63B 21/00
(52) U.S. Cl. ..... 482/130; 482/142; 482/133
(58) Field of Search ..... 482/129, 103, 482/121, 104, 142, 130–736; 128/125 R

(56) References Cited

U.S. PATENT DOCUMENTS 4,620,704 A * 11/1986 Shifferaw ..... 482/130
4,635,934 A * 1/1987 Roethke ..... 482/130
5,123,886 A * 6/1992 Cook ..... 482/129

OTHER PUBLICATIONS

Tom Purvis, Bowflex Power Pro for all Power PRO Models, Bowflex Fitness Owner's Manual & Fitness Guide, pp. 1–77 (1997).

Tom Purvis, Bowflex Motivator for all Motivator Models, *Strength Training System*, Bowflex Fitness Owner's Manual & Fitness Guide, pp. 1–46 (1997).

Tom Purvis, Bowflex Ultimate, Bowflex Power Pro, Bowflex Fitness Owner's Manual & Fitness Guide, pp. 1–81 (2001).

* cited by examiner

*Primary Examiner*—Jerome W. Donnelly
(74) *Attorney, Agent, or Firm*—Pillsbury Winthrop LLP

(57) ABSTRACT

An exerciser featuring a frame assembly which includes a lower frame portion that is constructed and arranged to be stablely supported in an operative position on a horizontal surface. First and second rigid upright support members is fixed at lower end portions thereof on the lower frame portion and extends upwardly from the lower frame portion when in the operative position thereof. A user support assembly is operatively connected with the lower frame portion and is constructed and arranged to support a user thereon. The first and second rigid upright support members have first and second rigid upper free end portions respectively configured to curve upwardly from the lower portions thereof in outwardly diverging relation with respect to one another. A pair of separate moving assemblies is disposed in normal inoperative positions with respect to the user support assembly. Each moving assembly is constructed and arranged to be manually engaged and individually manually moved away from the normal inoperative position thereof into a desired extended position by a user supported on the user support assembly.

22 Claims, 8 Drawing Sheets

BENCH EXERCISER WITH UPWARDLY DIVERGING BUNGEE CORD SUPPORTS

FIELD OF THE INVENTION

This invention relates generally to exercisers and more specifically to exercisers including separate moving assemblies enabling a user to perform various different exercises.

BACKGROUND OF THE INVENTION

Recent years have seen an increasing awareness of the benefits of physical exercise and widespread use of exercisers. The therapeutic value of progressive resistance exercises has long been recognized. Exercising muscles against progressively increasing resistance not only results in added strength and endurance in the muscles, but also in a more efficient functioning of the cardiovascular and respiratory systems.

Nowadays, various types of exercisers have been suggested which use elastomeric members, such as resistance bands, to provide non-gravity resistance to the performance of the exercises.

One such exerciser is described in U.S. Pat. No. 5,674,167 issued to Piaget et al. The exerciser taught by Piaget et al. includes a first set of bungee cords for providing resistance to the movement of first and second hand grips and a second set of bungee cords for providing resistance to the movement of a leg actuated member. Each bungee cord of each set is removably secured between a fixed terminal and a movable terminal such that a selected number of first bungee cords provides resistance to the movement of the hand grips independently from the resistance a selected number of second bungee cords provided to movement of the leg actuated member. Varying the resistance by using bungee cords as taught by Piaget et al. involves adding or subtracting individual bungee cords to the exerciser, which can be both burdensome and time consuming. Further, since each bungee cord is a separate unit, the bungee cords can be lost or misplaced, or strewn about the environment of the exerciser in a manner to create substantial tripping hazards.

Another exerciser that uses bungee cords is described in U.S. Pat. No. 5,906,566 issued to Whitcomb. The exerciser taught by Whitcomb includes a single set of bungee cords for selectively providing resistance to the movement of handle grips or to the movement of a leg actuated unit, each of which are connected to opposite ends of the bungee cords. Whitcomb provides an exercise machine having a single set of bungee cords, which may be moved into different exercise positions. The resistance of the bungee cords can be varied by selectively connecting a number of the bungee cords of the set to either the hand grips or the leg actuated member. The bungee cords are not removed from the exercise machine during normal usage as described in Piaget, thus eliminating the possibility to be lost or tripped over. Even though the exercise machine is relatively versatile, it includes numerous pivotally movable components, which can be relatively bulky and can require many steps to maneuver the exercise machine into various positions for effecting the different modes of exercise. These extra steps require extra time to move the exercise machine between different positions and can significantly lengthen the workout. Thus, the ability to effect different exercises quickly is greatly desirable and helps to reduce unnecessary time between exercises.

Consequently, there exists a need in the art to provide an exerciser which is cost-effective, convenient for transportation, versatile, and capable of providing variable resistance without removing components thereof.

BRIEF SUMMARY OF THE INVENTION

An object of the present invention is to achieve the aforesaid improvement. In accordance with the principles of the present invention, this objective is achieved by providing an exerciser which features a frame assembly including a lower frame portion that is constructed and arranged to be stablely supported in an operative position on a horizontal surface. First and second rigid upright support members is fixed at lower end portions thereof on the lower frame portion and extends upwardly from the lower frame portion when in the operative position thereof. A user support assembly is operatively connected with the lower frame portion. The user support assembly is constructed and arranged to support a user thereon.

The first and second rigid upright support members has first and second rigid upper free end portions respectively configured to curve upwardly from the lower portions thereof in outwardly diverging relation with respect to one another. First and second moving assemblies is disposed in normal inoperative positions with respect to the user support assembly. Each moving assembly is constructed and arranged to be manually engaged and individually manually moved away from the normal inoperative position thereof into a desired extended position by a user supported on the user support assembly.

The first and second moving assemblies comprise first and second upper pulley members rotatably mounted on the upper free end portions of the first and second rigid upright support members. First and second lower pulley members are rotatably mounted on the frame assembly at fixed positions below the upper pulley members and first and second flexible elongated structures trained around the lower pulley members. The first and second flexible elongated structures extend upwardly over the first and second upper pulley members respectively and then downwardly toward the lower frame portion.

Movement preventing structures on the lower frame portion are operatively associated with terminal portions of the first and second flexible elongated structures and extend downwardly from the first and second upper pulley members. The movement preventing structures are constructed and arranged to prevent upward movements of the terminal portions. First and second user hand grip units is connected with first and second end portions of the first and second flexible elongated structures. The first and second user hand grip units extend outwardly from the lower pulley members in positions to enable a user supported on the user support assembly to move the user hand grip units away from inoperative positions thereof into desired extended positions.

The first and second flexible elongated structures include first and second bungee cords constructed and arranged to resiliently resist movement of the user hand grip units and the end portions of the flexible elongated structures away from the inoperative positions thereof into desired extended positions. The first and second bungee cords are further constructed and arranged to resiliently return the user hand grip units to the inoperative positions thereof when no longer moved by the user.

The present invention may be applied to U.S. patent application Ser. No. 09/738,317 filed concurrently herewith and hereby incorporated by reference in its entirety. The incorporated disclosure provides an exerciser which comprises an upright frame assembly, first and second moving assemblies, a third moving assembly, first, second and third connecting terminals and a pair of resilient resistance structures. The upright frame assembly is constructed and arranged to be disposed in an operative position supported on a horizontal surface. The upright frame assembly has a user support assembly constructed and arranged to support a user thereon.

The first and second moving assemblies are disposed in normal inoperative positions with respect to the user support assembly and are constructed and arranged to be manually engaged and individually manually moved away from the normal inoperative position thereof into a desired extended position by a user supported on the user support assembly.

The third moving assembly is disposed in a normal inoperative position with respect to the user support assembly. The third moving assembly is constructed and arranged to be engaged and moved away from the normal inoperative position thereof into a desired extended position by a user supported on the user support assembly.

The first, second and third connecting terminals are connected to the first, second and third moving assemblies, respectively, so that the first and third connecting terminals and the second and third connecting terminals move away from one another when any one of the moving assemblies is moved away from the normal inoperative position thereof.

The pair of resilient resistance structures has operative extents and is constructed and arranged to be separately connected between the first and third connecting terminals and between the second and third connecting terminals. The pair of resilient resistance structures provide resilient resistance throughout the operative extent thereof to the relative movement of the first and third connecting terminals and the second and third connecting terminals away from one another and a resilient bias throughout the operative extent thereof to move the first and third connecting terminals and second and third connecting terminals toward one another.

The resilient resistance structures are related to the upright frame assembly such that the first and third connecting terminals and the second and third connecting terminals are restrained against biased movement toward one another beyond normal inoperative positions thereof corresponding generally with the normal inoperative positions of the moving assemblies. The resilient resistance structures permit the first and third connecting terminals and the second and third connecting terminals to move relatively away from one another so that (1) manual movement of the first moving assembly away from the inoperative position thereof causes the first connecting terminal to move away from the third connecting terminal enabling the resilient structure connected thereto to provide resilient resistance throughout the operative extent thereof to the movement of the first moving assembly away from the inoperative position thereof, (2) manual movement of the second moving assembly away from the inoperative position thereof causes the second connecting terminal to move away from the third connecting terminal enabling the resilient structure to provide resilient resistance throughout the operative extent thereof to the movement of the second moving assembly away from the inoperative position thereof, and (3) movement of the third moving assembly away from the inoperative position thereof causes the third connecting terminal to move away from the first and second connecting terminals enabling the pair of resilient structures connected thereto to provide resilient resistance throughout the operative extent thereof to the movement of the third moving assembly away from the inoperative position thereof.

A further object or aspect of the invention is to provide an exerciser comprising a frame assembly that includes a lower frame portion constructed and arranged to be stablely supported in an operative position on a horizontal support surface and left and right rigid upright support members fixed at lower end portions thereof on the lower frame portion.

A user support assembly is operatively connected with the frame assembly and constructed and arranged to support a user thereon. An exercising system is carried by the frame assembly and is constructed and arranged to enable a user supported on the user support assembly to perform arm exercises with either or both arms.

The left and right rigid upright support members have left and right upper free ends disposed above the lower frame portion in outwardly diverging relation with respect to one another.

The exercising system includes (1) left and right pulleys mounted on the left and right free ends of the left and right rigid upright support members respectively (2) elongated structures, some of which are trained ever the left and right pulleys and (3) left and right hand grips constructed and arranged to be gripped by both hands of a user and to be moved individually or simultaneously through exercising strokes.

The elongated structures include left and right flexible non-extendable elongated structures that are connected to the left and right hand grips respectively for movement through operative strokes in response to the exercising strokes of the left and right hand grips by the user. The elongated structures further include resiliently extensible and retractable elongated structures constructed and arranged to (1) resiliently extend so as to provide yielding resistance to the operative strokes of the flexible non-extensible elongated elements and the exercising strokes of the hand grips by the user and (2) resiliently retract so as to provide return strokes for the flexible non-extensible elongated elements and the hand grips after the operative and exercising strokes thereof.

Yet another object or aspect of the invention is to provide an exerciser comprising a frame assembly that includes a lower frame portion constructed and arranged to be stablely supported in an operative position on a horizontal support surface and left and right rigid upright support members fixed at lower end portions thereof on the lower frame portion.

A user support assembly is operatively connected with the frame assembly and constructed and arranged to support a user thereon.

The left and right rigid upright support members have left and right upper free ends disposed above the lower frame portion in outwardly diverging relation with respect to one another.

Left and right exercising assembles on the frame assembly are constructed and arranged to be manually moved through exercising strokes by both hands of a user supported on the user support assembly. The left and right exercising assembles include left and right operative structures carried by the left and right upper free ends of the left and right rigid upright support members, respectively.

Other objects, features, and advantages of the present invention will become apparent from the following detailed description, the accompanying drawings, and the appended claims.

DETAILED DESCRIPTION OF THE INVENTION

Figure 1:
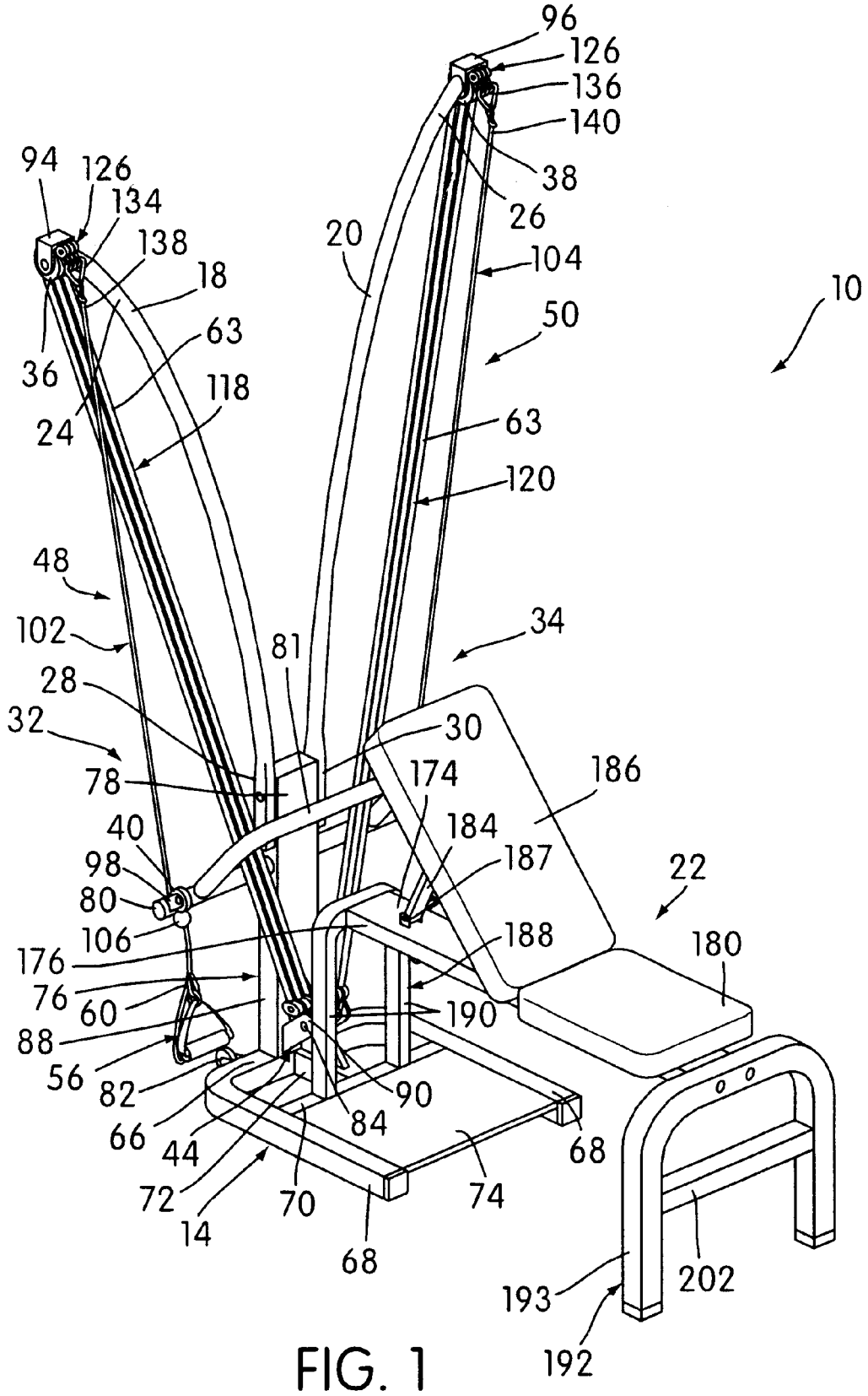
FIG. 1 is a perspective view of an exerciser embodying the principles of the present invention shown in an inline bench position.
Figure 2:
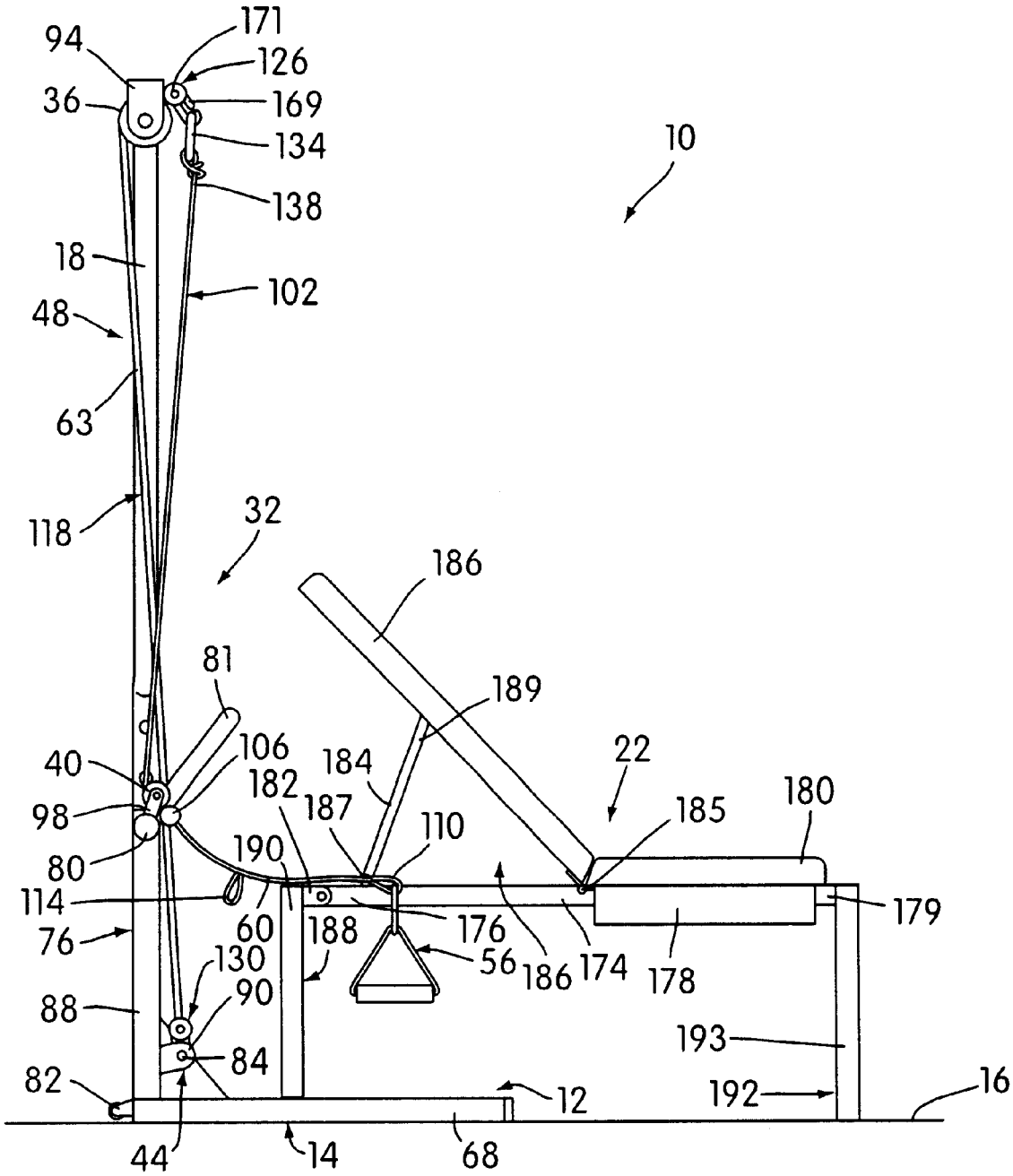
FIG. 2 is a side view of the exerciser of FIG. 1.

Referring now more particularly to the drawings, FIGS. 1 and 2 illustrate an exerciser, generally indicated at 10, embodying the principles of the present invention. The exerciser 10 comprises a frame assembly, generally indicated at 12. The frame assembly 12 includes a lower frame portion, generally indicated at 14, constructed and arranged to be stablely supported in an operative position on a horizontal surface 16 and a user support assembly, generally indicated at 22, operatively connected with the lower frame portion 14 to support a user thereon.

First and second rigid upright support members 18, 20 are fixed at lower end portions 28, 30 thereof on the lower frame portion 14 and extend upwardly from the lower frame portion 14 when in the operative position thereof. The first and second rigid upright support members 18, 20 have first and second (or left and right) rigid upper free end portions 24,26, respectively. The upper free end portions 24, 26 are configured to curve upwardly from the lower portions 28, 30 thereof in outwardly diverging relation wit respect to one another. As such, the first and second rigid upper free end portions 24, 26 have integral laterally spaced left and right upper free ends disposed above the lower frame portion 14 in outwardly diverging relation with respect to one another.

A pair of separate moving assemblies 32, 34 is disposed in normal inoperative positions with respect to the user support assembly 22. Each moving assembly 32, 34 is constructed and arranged to be manually engaged and individually manually moved away from the normal inoperative position thereof into a desired extended position by a user supported on the user support assembly 22.

The first and second moving assemblies 32, 34 include first and second upper pulley members 36, 38 rotatably mounted on the upper free end portions 24, 26 of the first and second rigid upright support members 18, 20, respectively. First and second lower pulley members 40, 42 are rotatably mounted on the frame assembly 12 at fixed positions below the upper pulley members 36, 38, respectively. First and second flexible elongated structures, generally indicated at 48, 50, are trained around the lower pulley members 40, 42 and extend upwardly over the first and second upper pulley members 36, 38 respectively. Terminal ends 52, 54 of the first and second flexible elongated structures 48,50 extend downwardly from the upper pulley members 36, 38 toward the lower frame portion 14.

A movement preventing structure 44 on the lower frame portion 14 is operatively associated with the terminal portions 52, 54 of the first and second flexible elongated structures 48, 50. The movement preventing structure 44 is constructed and arranged to prevent upward movements of the terminal portions 52, 54.

First and second user hand grip units 56, 58 is connected with the first and second end portions 60, 62 of the first and second flexible elongated structures 48, 50, respectively. The end portions 60, 62 extend outwardly from the lower pulley members 40, 42 in positions to enable a user supported on the user support assembly 22 to move the user hand grip units 56, 58 away from inoperative positions thereof into desired extended positions.

The first and second flexible elongated structures 48, 50 include bungee cords 63, which constitute resilient resistance structures. The bungee cords 63 resiliently resist movement of the user hand grip units 56, 58 and the end portions 60, 62 of the flexible elongated structures 48, 50 away from the inoperative positions thereof into desired extended positions. The bungee cords 63 are further configured to resiliently return the user hand grip units 56, 58 to the inoperative positions thereof when no longer moved by the user.

The lower frame assembly 14 includes a substantially symmetrical U-shaped support base 64 having a generally straight central section 66 and a pair of spaced legs 68 which extend from the central section 66 to provide support to the lower frame portion 14 of the exerciser 10. A cross member 70 extends between the support legs 68 in parallel spaced relation to the central section 66 and a support bar 72 extends from the mid-portion of the central section 66 toward the cross member 70 in order to provide additional support to the lower frame portion 14. A cover plate 74 is positioned in abutting relation to the cross member 70 so as to form a common plane therewith which covers the area extending between the spaced legs 68.

As best shown in FIG. 1, a mounting support member 76 vertically extends from the central section 66 of the support base 64. The mounting support member 76 may be made from metal having a hollow transverse cross section, preferably substantially rectangular in form so as to provide sufficient strength and support to the lower frame assembly 14 of the exerciser 10. A removable or non-removable rubber cap (not shown) may be provided to seal the hollow transverse cross section of the mounting support member 76.

Other optional exercise components, such as a hand grip bar assembly or a pull down bar assembly, may be positioned within the mounting support member 76 to provide added versatility to the exerciser 10.

A pulley mounting member 80 is mounted to an upper portion 78 of the mounting support member 76. The pulley mounting member 80 extends transversely with respect to the mounting support member 76 so as to form a cross or t-shape therewith. The pulley mounting member 80 is preferably tubular in form and welded to the mounting support member 76 for additional structural rigidity of the lower frame portion 14.

A protruding member 81 outwardly and upwardly extends from the pulley mounting member 80 such that during certain exercises described below, the user may position his/her feet thereon, e.g. for resting purposes. The protruding member 81 is generally C-shaped and may be adapted to retain the bungee cords 63 within a confined area of lateral movement in cooperation with the pulley mounting member 80.

Extending outwardly from a lower portion 88 of the mounting support member 76 is a pair of mounting brackets 90 of the movement preventing structure 44. The movement preventing structure 44 includes a hook connector receiving member 84 in the form of a metal bar attached between the mounting brackets 90 and is adapted to receive a lower hook connector 130 of each bungee cord 63, as will be described in further detail below. Alternatively, the hook connector receiving member 84 may be in the form of a metal ring connected to the lower end portion 88 of the mounting support member 76 or may be configured in any other manner capable of receiving the lower hook connector 130 of each bungee cord 63.

As shown in FIGS. 1 and 2, each rigid upright support member 18, 20 is mounted, preferably by fasteners or welding, at respective lower portions 28, 30 thereof to the mounting support member 76. For example, in the exemplary embodiment, the rigid upright support members 18, 20 are connected to opposite sides of the mounting support member 76 and positioned slightly above the pulley mounting member 80.

A pair of horizontally spaced rollers 82 are rotatably mounted on the generally straight central section 66 of the lower frame 14 for rotation about a horizontal axis parallel to the central section 66. The rollers 82 are positioned to facilitate the transport of the exerciser 10 to different locations of use, as will be described in further detail below.

In the exemplary embodiment, the first and second upper pulley members 36, 38 have an upper stop structure 94, 96, respectively, which extends across a peripheral portion thereof. The upper stop structures 94, 96 rotatably mount the first and second upper pulley members 36, 38, respectively on the upper free end portions 24, 26 of the first and second rigid upright support members 18, 20.

FIGS. 1 and 2 illustrate a pair of lower stop structures 98, 100 diagonally extending upwardly and outwardly from the pulley mounting member 80. The lower stop structures 98, 100 rotatably mount the lower pulley members 40, 42 in horizontally spaced relation on the pulley mounting member 80 such that the lower stop structures 98, 100 extend across a peripheral portion of the lower pulley members 40, 42, respectively.

The first and second flexible elongated structures 48, 50 further include first and second flexible elongated non-extensible elements 102, 104. The first and second flexible elongated non-extensible elements 102, 104 are trained around the lower pulley members 40, 42 so as to provide the first and second outwardly extending end portions 60, 62, respectively. Each non-extensible element 102, 104 has a stop element 106, 108, respectively, fixed to the respective end portion 60, 62 thereof. Each non-extensible element 102, 104 interengages with the respective lower stop structure 98, 100 to determine the inoperative position of the first and second moving assemblies 32, 34, respectively. More specifically, the stop elements 106, 108 cooperate with the stop structure 98, 100 of the respective lower pulley members 40, 42 to determine the inoperative positions of the end portions 60, 62 of the non-extensible elements 102, 104.

The end portions 60, 62 of the non-extensible elements 102, 104 have respective looped end portions 110, 112. The looped end portions 110, 112 are configured to connect with the first and second hand grip units 56, 58, respectively. The stop elements 106, 108 are fixed on the non-extensible elements 102, 104 in spaced relation to the looped end portions 110, 112 thereof. Looped intermediate portions 114, 116 are disposed between the associated stop elements 106, 108 and the respective looped end portions 110, 112 of the non-extensible elements 102, 104. The looped intermediate portions 114, 116 are configured to selectively receive the first and second hand grip units 56, 58, respectively, in connecting relation thereto.

Figure 3:
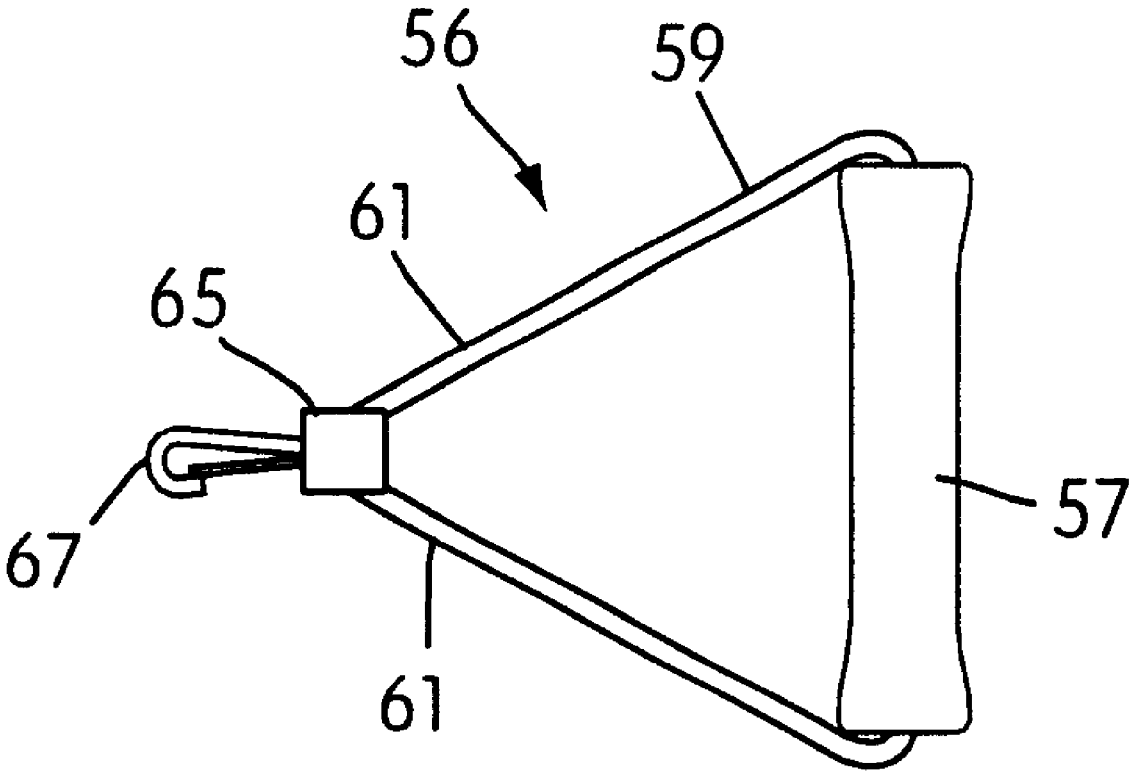
FIG. 3 is a side view of a hand grip unit illustrated in FIG. 1.

FIG. 3 illustrates the hand grip unit 56. The hand grip units 56, 58 are the same in construction and the description of the hand grip unit 56 will suffice for both. As best shown in FIG. 3, each hand grip unit 56, 58 includes a tubular gripping member 57 which is manually engageable by the user during various exercises. A flexible strap 59, such as nylon or cable, extends through the gripping member 57 to provide free ends 61. A binding member 65 binds the free ends 61 together and secures the gripping member 57 between the free ends 61. A latching or securing member 67 is releasably secured to the binding member 65 at one end thereof in a position which facilitates the other end thereof to latch onto the first and second moving assemblies 32, 34, respectively, through the looped portions 110, 112, 114, or 116. When the latching member 67 is latched onto one of the first and second moving assemblies 32, 34, a force exerted on the gripping member 57 by the user moves the respective moving assembly 32, 34 on which the gripping assembly 57 is attached.

Alternatively, the hand grip units 56, 58 may include the tubular gripping member 57 and any known rigid member for securing the latching member 67 thereto. The latching member 67 may be of any known configuration.

In the exemplary embodiment, the bungee cords 63 are grouped into a first and second series of resiliently extensible bungee cords 118, 120 associated with the first and second moving assemblies 32, 34, respectively. Each series of bungee cords 118, 120 may include three bungee cords 63, each providing a resilient resistance.

In an exemplary embodiment, each series of bungee cords 118, 120 includes one bungee cord 63 that provides ten pounds of resistance and two bungee cords 63 that each provide twenty pounds of resistance. However, any number of bungee cords 63 may be used in each series 118, 120 and the bungee cords 63 can have equal or different resilient resistances so as to provide the desired resilient resistance.

Each bungee cord 63 in the first and second series 118, 120 has an upper end portion 122 trained around one of the upper pulley members 36, 38 and a lower end portion 124 attached to hook connector receiving member 84.

Figure 4:
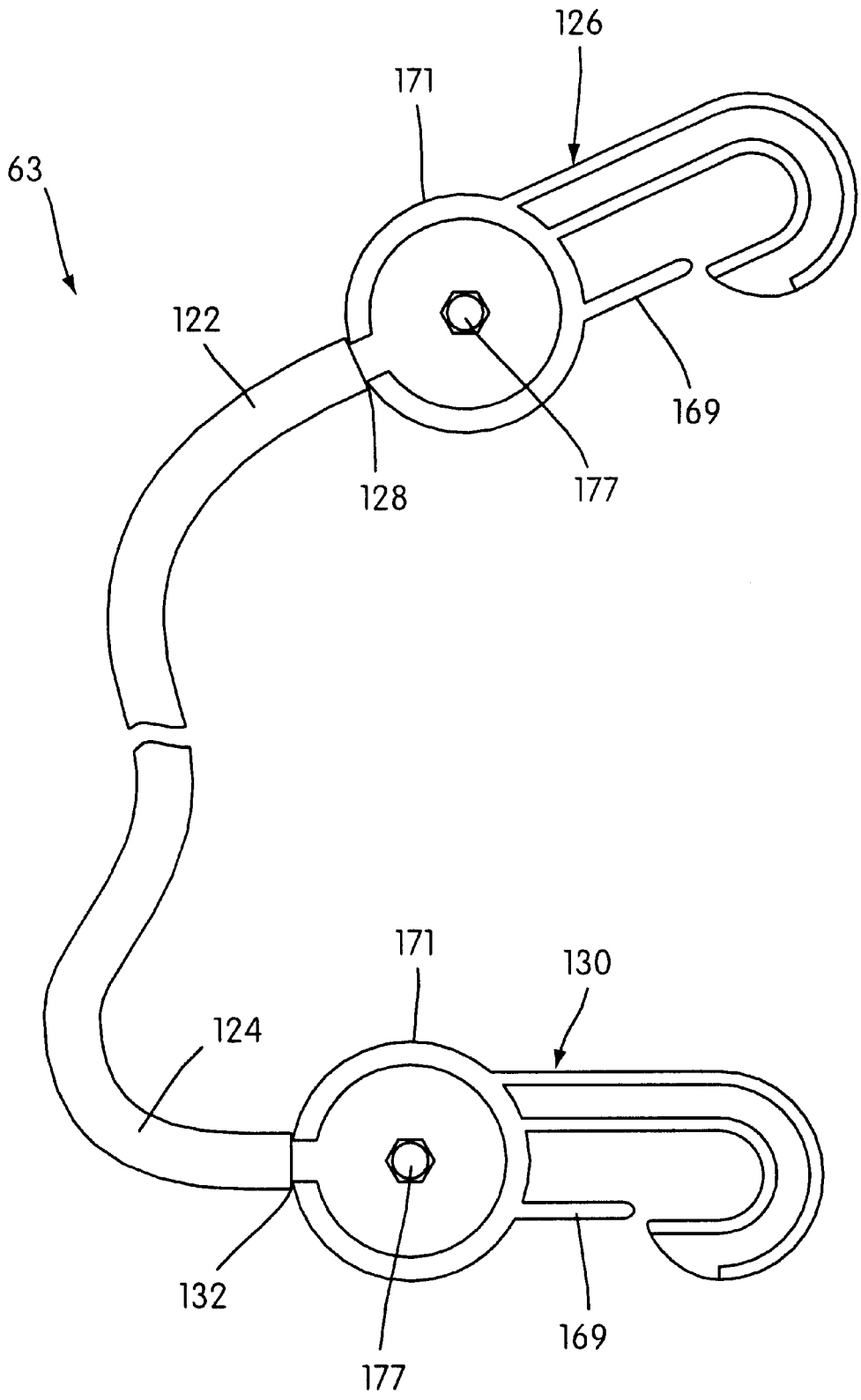
FIG. 4 is a side view of a bungee cord illustrated in FIG. 1.

As best shown in FIG. 4, an upper hook connector 126 is fixed on each terminal end 128 of the bungee cords 63 and the lower hook connector 130 is fixed on each terminal end 132 of the bungee cords 63.

The upper hook connectors 126 selectively engage with first and second connecting terminals 134, 136, respectively, so that the first and second connecting terminals 134, 136 move substantially in the same direction when the respective moving assemblies 32, 34 are moved away from the normal inoperative position thereof.

The connecting terminals 134, 136 are fixedly disposed on adjacent ends 138, 140 of the associated non-extensible element 102, 104 to provide resilient resistance thereto. For example, the adjacent ends 138, 140 of the non-extensible elements 102, 104 may be fixedly disposed on the connecting terminals 134, 136 by a hook connector or by tying the ends 138, 140 around the respective connecting terminal 134, 136. The connecting terminals 134, 136 are disposed in close proximity to the associated upper stop structure 94, 96 when the moving assemblies 32, 34 are in an inoperative position thereof.

The lower hook connectors 130 selectively engage the hook connector receiving member 84 to prevent upward movements of the terminal ends 52, 54 of the first and second elongated structures 48, 50 while the exerciser 10 is being operated.

Alternatively, in an embodiment not shown, the first and second elongated structures 48, 50 may be fixed at the terminal ends 52, 54 thereof to the hook connector receiving member 84 to prevent upward movements thereof, such as, for example, by tying the terminal ends 52, 54 around the hook connector receiving member 84.

The number of hook connectors 126 connected to each connecting terminal 134, 136 determines the number of bungee cords 63 resisting movement of the corresponding moving structure 32, 34 away from the inoperative position thereof. In the exemplary embodiment, each bungee cord 63 provides a resilient resistance and the total resistance provided with respect to any moving assembly 32, 34 can be varied by virtue of a selection of any one, any two or all three bungee cord hook connectors 126 to be connected to the associated connecting terminal 134, 136.

It may be preferable for the connecting terminals 134, 136 to be constructed in the form of rigid annular members, such as metal rings, but the connecting terminals 134, 136 could be formed into any rigid configuration capable of being engaged by the hook elements 126.

FIG. 4 illustrates a bungee cord 63 having the hook connectors 126, 130 disposed on opposite terminal ends 128, 132 thereof. Each hook connector 126, 130 includes a flexible movable element 169 extending from an enlarged annular portion 171. The flexible movable elements 169 are preferably made from plastic so as to allow easy passage of the respective connecting terminal 134, 136 or hook connector receiving element 84 therethrough. That way, each hook connector 126, 130 may be quickly connected to and quickly disconnected from either the respective connecting terminal 134, 136 or the hook connector receiving member 84.

The annular portions 171 of the hook connectors 126 are constructed to engage the respective upper stop structures 94, 96, respectively, when the first and second moving assemblies 32, 34 are moved into the normal inoperative positions thereof.

Extending through each hook connector 126, 130 is a conventional fastener 177, which fixedly secures each bungee cord 63 thereto. The fastener 177 secures the bungee cords 63 to the annular portions 171 so that forces exerted on the bungee cords 63 can be transmitted through the respective hook connector 126, 130 without the bungee cords 63 becoming unattached from the annular portions 171.

The hook connectors 126, 130 may be molded from a plastic material, however, it is contemplated that the hook connectors 126, 130 may be constructed in any known manner. The hook connectors 126, 130 may be of any known material capable of providing sufficient strength or rigidity that may easily connect and disconnect from the connecting terminals 134, 136.

Figure 5:
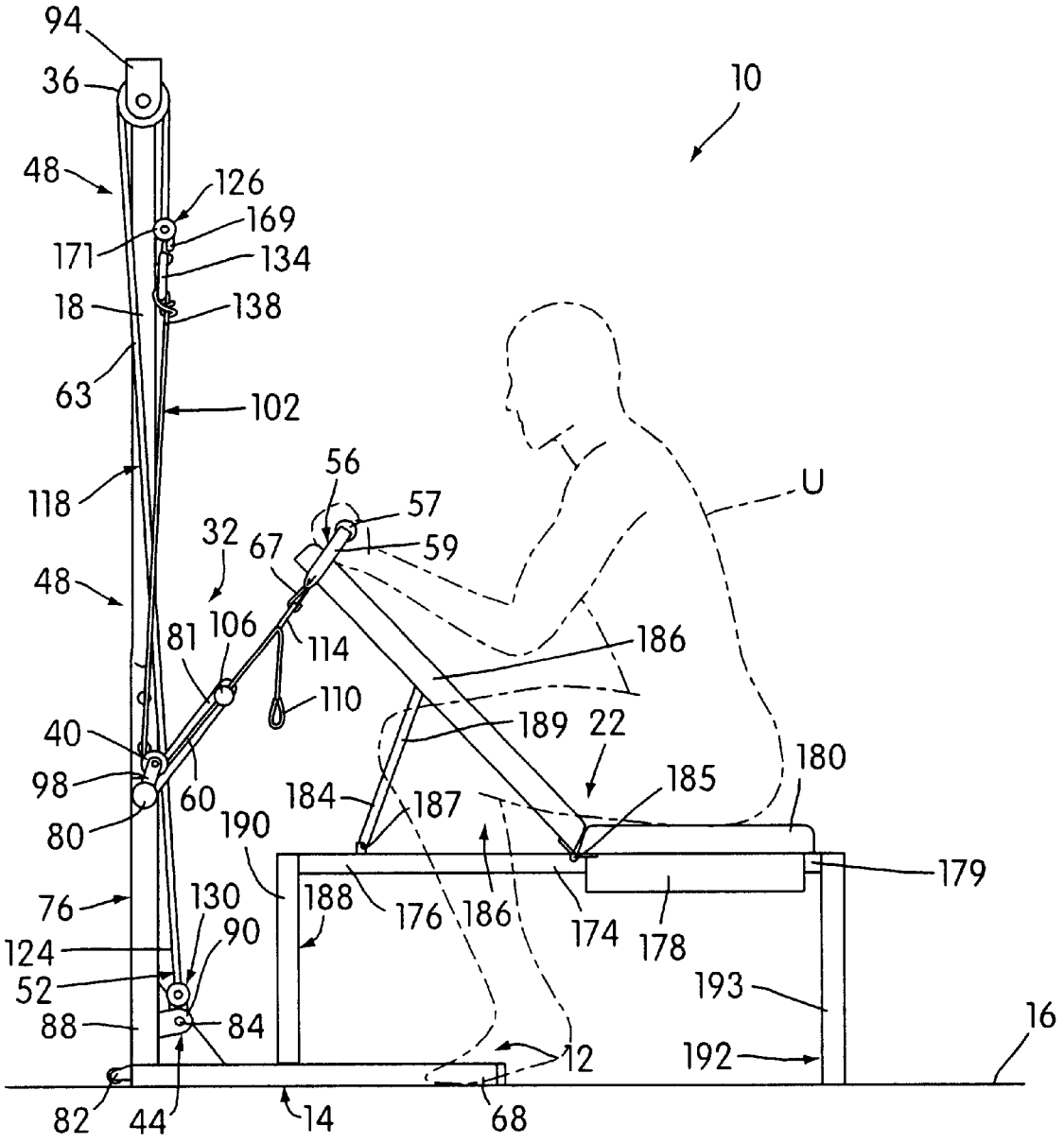
FIG. 5 is a side view of the exerciser of FIG. 2 but a user effecting a curl exercise.

As best shown in FIGS. 1, 2 and 5, the user support assembly 22 includes an elongated support member 174. The elongated support member 174 has one end 176 connected to a U shaped frame support member 188, with the opened portion of the U configuration facing downwardly toward the cross member 70 and an opposite end 179 connected to an outer leg structure 192. Spaced ends 190 of the support member 188 are integrally attached to cross member 70 in substantially perpendicular relation thereto. The elongated support member 174 extends in an operative position generally horizontally outwardly from the support member 188 and may be welded thereto to effect attachment thereof.

The outer leg structure 192 is generally U-shaped and opens downwardly to have a pair of spaced ends 193. The outer leg structure 192 is fixed, preferably by welding, to the elongated support member 174. The spaced ends 193 of the outer leg structure 192 engage and are supported on the horizontal surface 16 in spaced relation to the frame 12. The spaced legs 193 support the elongated support member 174 while the elongated support member 174 is in the generally horizontally outwardly extending relation from the U shaped member 188 and the lower frame portion 14.

A support member 202 extends between the spaced ends 193 of the outer leg structure 192 so as to provide support to the user support assembly 22 when a user is positioned thereon.

In the exemplary embodiment, a user seat member 180 is fixedly mounted onto the elongated support member 174 in parallel relation with respect thereto via a support assembly 178. The support assembly 178 may be welded to the elongated support member 174 or may be fixedly secured in any other conventional manner, such as by fasteners extending through the elongated support member 174.

A pivoted strut frame 184 is disposed in fixed supporting relation to a seat back member 186, which may be connected to the user seat member 180 by a conventional hinge mechanism 185. A pair of ends 187, 189 of the pivoted strut frame 184 fixedly connect the elongated support member 174 outwardly of the support member 188 and the seat back member 186, respectively. It may be preferable for the seat member 180 and the seat back member 186 to be disposed at a predetermined angle with respect to one another. That way, a user may be seated comfortably thereon while effecting various exercises, which will be described in further detail below.

It is contemplated that the user seat member 180 and the seat back member 186 may be adjustably slidably mounted on the elongated support member 174 by modifying the support assembly 178. For example, a series of rollers (not shown) may be conventionally secured to the support assembly 178 so as to engage oppositely facing sides of the elongated support member 174 in rolling relation thereto. That way, the user seat member 180 may be moved between different operative positions thereof in response to the rollers rolling along the elongated support member 174.

OPERATION

In FIGS. 5–8, a user U is shown schematically. Motions of the user's arms, legs, or body, as well as motions of the moveable parts of the exerciser 10 are illustrated by broken lines. Resistance is provided by the resilient bungee cords 63 and can be adjusted to suit the user's requirements and physical abilities, as described above. Various exercises are described below in connection with different positions of the user.

Before certain hand, arm or chest exercises can be performed, each hand grip unit 56, 58 must be attached to the respective moving assembly 32, 34. To attach the hand grip units 56, 58, the user U latches each hand grip unit 56, 58 to either the respective looped end portion 110, 112 or to the respective looped intermediate portion 114, 116 depending on the user's physical size. For example, a user of large physical size may be more comfortable with the hand grip unit 56, 58 attached to the looped intermediate portions 114, 116.

The hand grip units 56, 58 are identical in construction and operation, therefore only the operation of the hand grip unit 56 will be described below.

After latching the hand grip unit 56 to one of the looped portions 110, 114, the user U may perform various arm, chest and shoulder exercises therewith by moving the handgrip unit 56 away from the pulley member 40.

As best shown in FIGS. 1, 2 and 5–8, the first connecting terminal 134 is connected to the upper hook element 126 and the flexible elongated non-extensible element 102 so that they move substantially in the same direction when the moving assembly 32 is moved away from the normal and operative position thereof.

As the hand grip unit 56 is moved away from the lower pulley member 40, the lower hook connector 130 engages the lower bungee cord stop structure 90, which in turn, allows the moving assembly 32 to be manually moved downwardly away from the normal inoperative position thereof The bungee cords 63 may be constructed such that the hook elements 126, 130 are permitted to move relatively away from one another so that the manual movement of the first and second moving assemblies 32, 34 away from the inoperative positions thereof cause the first and second connecting terminals 132, 134 to move away from the third connecting terminal 142. The bungee cords 63 connected thereto provide resilient resistance throughout the operative extent thereof to the movement of the first and second moving assemblies 32, 34 away from the inoperative positions thereof.

Without sufficient manual force on the handgrip unit 56 away from the lower pulley 40, the bungee cords 63 provide a resilient bias throughout the operative extent thereof to move the first and third connecting terminals 134, 142 toward one another. The resilient bias of the bungee cords 63 will move the moving assembly 32 toward the normal inoperative position thereof until the stop element 106 on the flexible elongated non-extensible element 102 abuts the stop structure 98.

During various exercises, as will be described in greater detail below, it may be preferable for the user U to maintain manual force on the handgrip unit 56 away from the lower pulley member 40. That way, the bungee cords 63 provide continuous resilient resistance to the exercised muscle throughout the exercise.

Although exercises can be performed individually or successively, it is contemplated that the exercises described herein may be performed in any sequence. An exemplary workout having a particular exercise sequence is described below.

Figure 6:
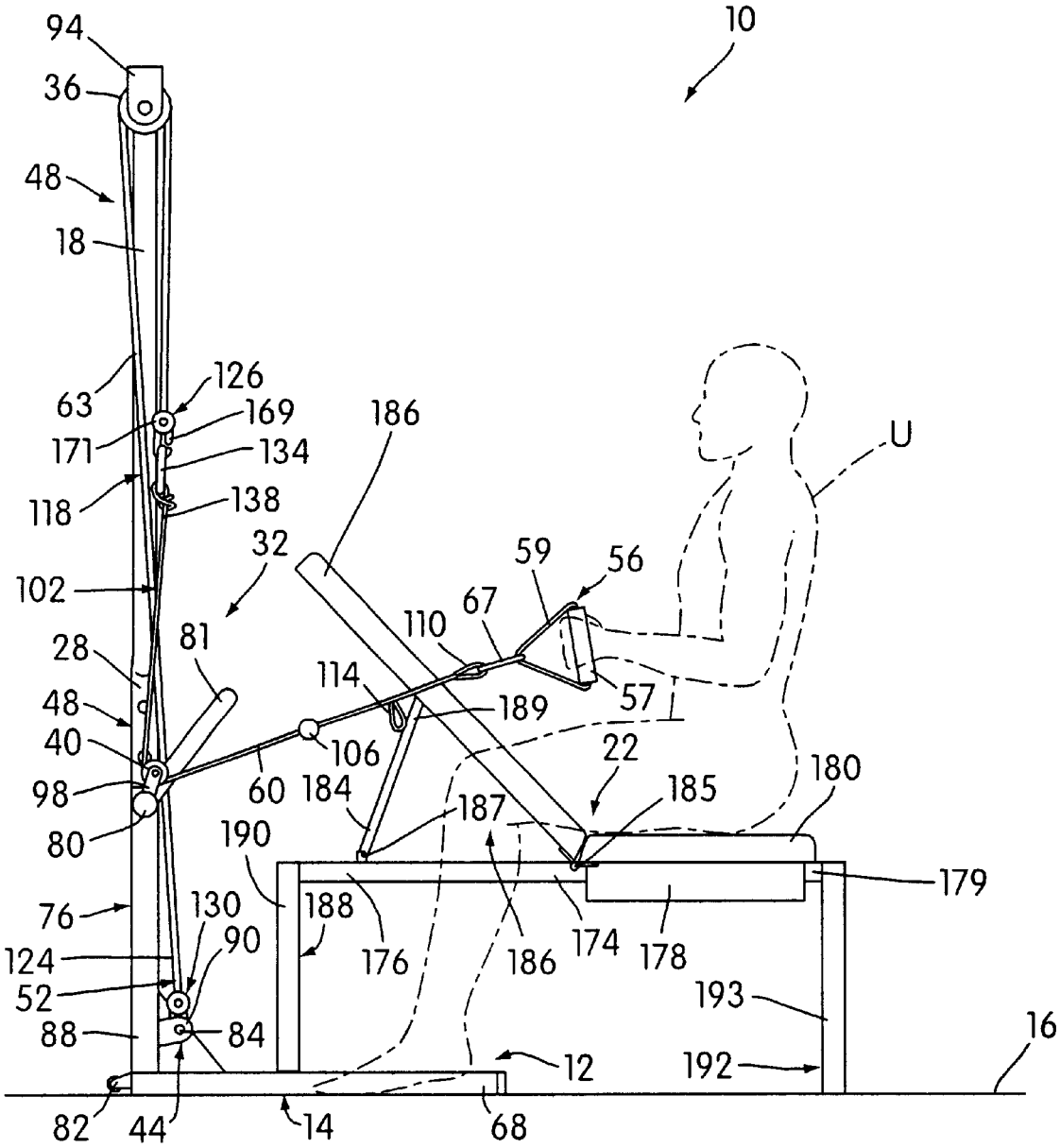
FIG. 6 is a side view of the exerciser of FIG. 2 but showing a user effecting a seated row exercise.
Figure 7:
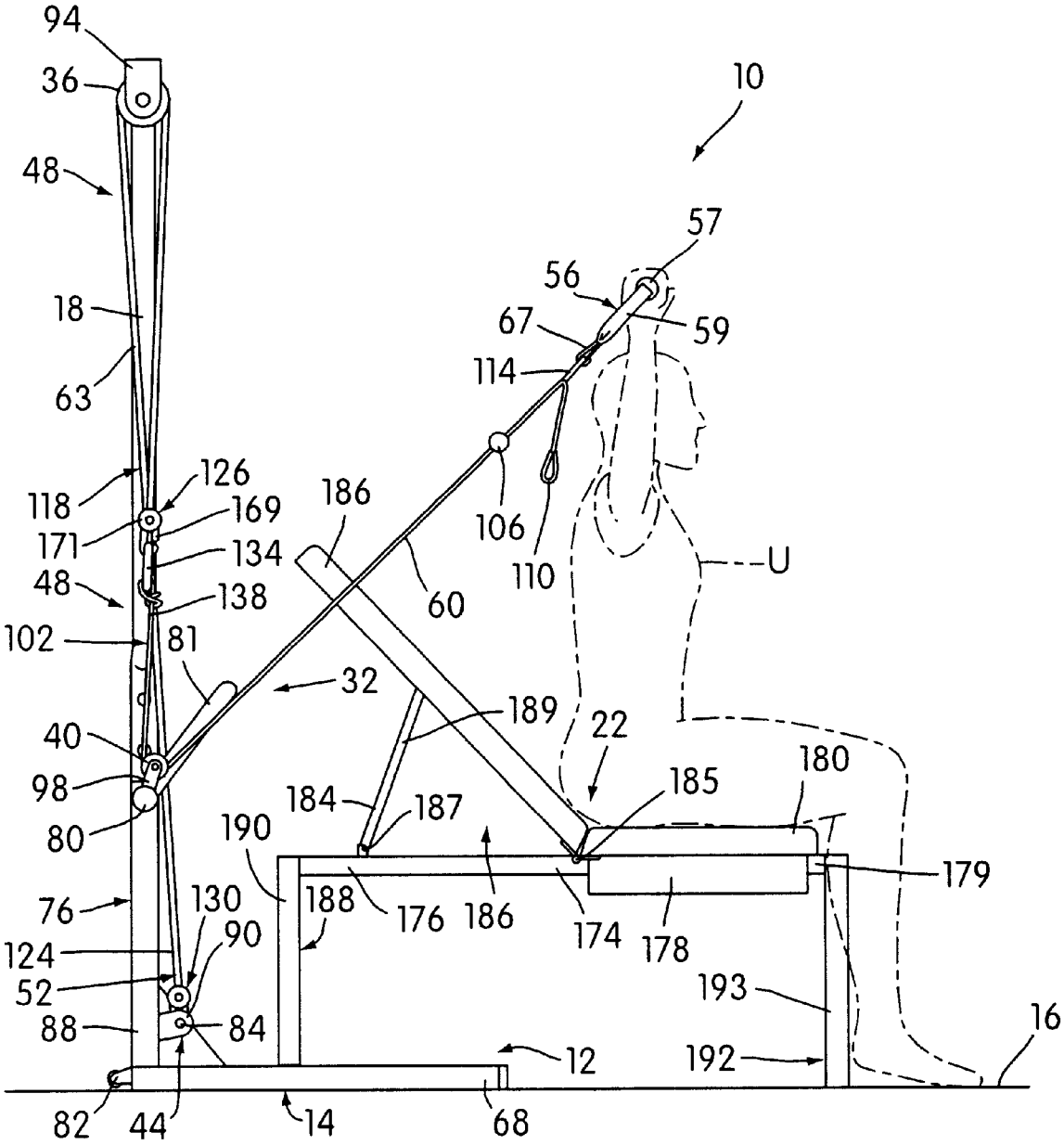
FIG. 7 is a side view of the exerciser of FIG. 2 but showing a user effecting a military press exercise.

As shown in FIGS. 5–7, the hand grip units 56, 58 are latched to the looped end portions 110, 112, respectively and the seat back member 186 is disposed at a upwardly sloping angle with respect to the user seat member 180. The exemplary exercises illustrated in FIGS. 5–7 may be performed with the exerciser 10 and are not meant to be limiting in any way.

The user U may perform various arm, chest and shoulder exercises using the hand grip units 56, 58. For example, as shown in FIG. 5, a biceps curl may be performed by the user U. First, the user U stands above the user seat member 180 with his/her feet straddling the user seat member 180 so as to face the rigid upright support members 18, 20 and then sits down onto the user seat member 180. The user U grasps the handgrip units 56, 58 so that his/her arms are fully extended downwardly and his/her palms face the rigid upright support members 18, 20. Then, the user U would bend his/her arms upwardly at his/her elbows so that the handgrip units 56, 58 would be pulled toward his/her shoulders. The bungee cords 63 resiliently resist this upward movement to exercise the biceps muscle of the user's arm.

Seated rowing exercises may be performed by the user U by sitting in the same position on the user seat member 180, except slightly leaning away from the rigid upright support members 18, 20 (as illustrated in relation to FIG. 6). The user U grasps the hand grip units 56, 58 with an over the handle grip and leans backward toward the leg-engaging unit 144. Then, the user U may clasp his/her fingers together so as to bring the hand grip units 56, 58 together. The user U pulls the hand grip units 56, 58 simultaneously toward his/her chest or abdomen against the resilient bias of the bungee cords 63. The user U may choose to rest his/her feet on the protruding member 81.

Alternatively, the user may not choose to clasp his/her fingers together when performing the seated row exercise. In this case, the hand grip units 56, 58 may be moved independently of one another against the resilient bias of the bungee cords 63.

As best illustrated in FIG. 7, the user U may reposition himself/herself in a seated position on the user seat member 180 so as to be facing away from the pulley mounting member 80. In this seated position, a military or shoulder press may be performed to exercise the arms and shoulders of the user U. To perform a military press, the user U grasps the handgrip units 56, 58 with an over the handle grip and bends his/her arms so to position them laterally and inline with his/her shoulders with his/her palms face upwardly. The user U would then extend the handgrip units 56, 58 above his/her head so to extend his/her arms against the resistance of the bungee cords 63.

A bench press exercise and a chest fly exercise may be performed to exercise certain arm, chest and shoulder muscles.

Figure 8:
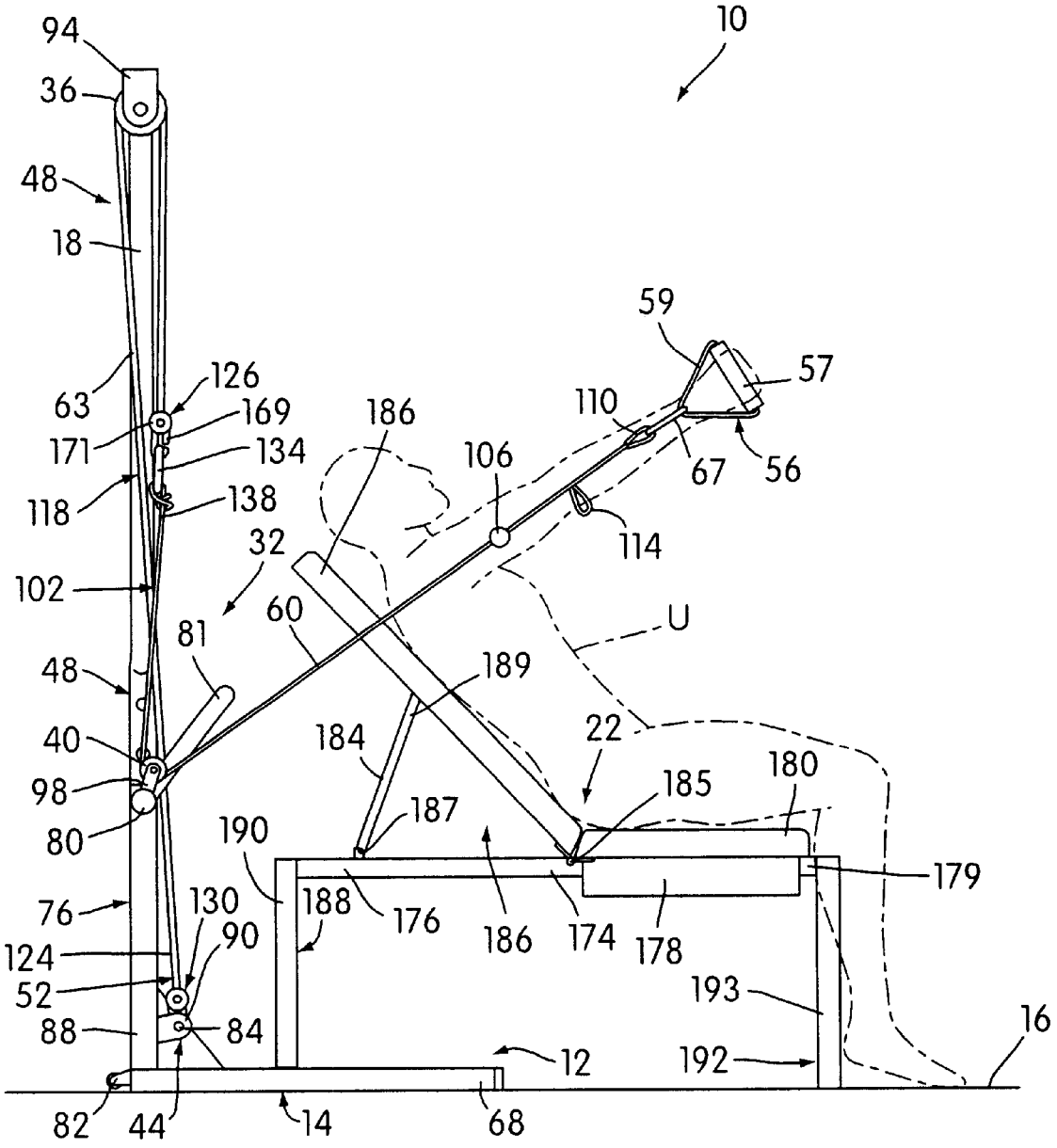
FIG. 8 is a side view of the exerciser of FIG. 2 but showing a user effecting a bench press exercise.

As best shown in FIG. 8, the chest fly exercise may be performed with the user U in the seated position such that the angled seat back member 186 supports his/her back. To perform the chest fly exercise, the user U would grasp the hand grip units 56, 58 and laterally extend his/her arms so that the hand grip units 56, 58 are extended away from his/her chest. Then, the user U moves the handgrip units 56, 58 in an forwardly arcuate, sweeping motion so as to bring the handgrip units 56, 58 together in front of his/her chest against the resilient resistance of the bungee cords 63. The user U would resist the resilient bias of the bungee cords 63 as he/she move his/her arms back to the laterally extended position in a rearwardly arcuate, sweeping motion.

Another exercise that may be performed with the user U sitting in this same seated position is a bench press exercise, which exercises the arms and chest of the user U. The user U would grasp the handgrip units 56, 58 with an over the hand grip and bends his/her arms so to position them laterally and inline with his/her shoulders with his/her palms face forwardly. The user U would then extend the handgrip units 56, 58 forwardly away from his/her chest so to extend his/her arms against the resistance of the bungee cords 63.

The exemplary workout described hereinabove is meant to illustrate one particular exercise sequence containing exemplary exercises that may be effected with the exerciser 10 and not meant to limit the exerciser 10 to those exemplary exercises described hereinabove.

The hand grip units 56, 58 may be stored on the pulley mounting member 80 when not in use. Also, the user U may grasp the hand grip units 56, 58 with different grips on the hand grip units 56, 58, e.g., an under the handle grip, so as to exercise different muscle groups of the user U for each exercise described hereinabove.

The user U may transport the exerciser 10 to different locations of use by tilting the frame assembly 12 onto the rollers 82. By tilting the frame assembly 12 in a direction opposed to the direction of the outward extent of the user support assembly 22, the rollers 82 can support the exerciser 10 thereon so as to facilitate movement thereof. The user U may tilt the frame assembly 12 onto the rollers 82 by holding onto the first and second rigid upright support members 18, 20 and pulling the support members 18, 20 backward (toward the rollers 82).

While the principles of the invention have been made clear in the illustrative embodiments set forth above, it will be apparent to those skilled in the art that various modifications may be made to the structure, arrangement, proportion, elements, materials, and components used in the practice of the invention.

For example, various other exercise components may be mounted to the exercise 10 to improve its versatility. A leg-engaging exercise unit may be pivotally attached to the end 179 of the elongated support member 174 so that a user may effect various leg exercises. Also, an overhead hand grip bar assembly may also be mounted to extend upwardly from the mounting support member 76 to effect additional arm, chest and shoulder exercises. Examples of suitable exercise components are illustrated in the incorporated U.S. patent application Ser. No. 09/738,317 filed concurrently herewith.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. An exerciser comprising:

a frame assembly including a lower frame portion constructed and arranged to be stably supported in an operative position on a horizontal surface and first and second rigid upright support members fixed at lower end portions thereof on said lower frame portion and extending upwardly from said lower frame portion when in the operative position thereof;

a user support assembly operatively connected with said lower frame portion constructed and arranged to support a user thereon;

said first and second rigid upright support members having first and second rigid upper free end portions respectively configured to curve upwardly from the lower portions thereof in outwardly diverging relation with respect to one another; and first and second moving assemblies disposed in normal inoperative positions with respect to said user support assembly constructed and arranged to be manually engaged and individually manually moved away from the normal inoperative position thereof into a desired extended position by a user supported on said user support assembly, said first and second moving assemblies comprising:

first and second upper pulley members rotatably mounted on the upper free end portions of said first and second rigid upright support members;

first and second lower pulley members rotatably mounted on said frame assembly at fixed positions below said upper pulley members;

first and second flexible elongated structures trained around said lower pulley members and extending upwardly over said first and second upper pulley members respectively and then downwardly toward said lower frame portion;

movement preventing structures on said lower frame portion operatively associated with terminal portions of said first and second flexible elongated structures extending downwardly from said first and second upper pulley members constructed and arranged to prevent upward movements of said terminal portions; and a pair of user hand grip units connected with first and second end portions of said first and second flexible elongated structures extending outwardly from said lower pulley members in positions to enable a user supported on said user support assembly to move said user hand grip units away from inoperative positions thereof into desired extended positions;

said first and second flexible elongated structures including first and second bungee cords constructed and arranged to resiliently resist movement of said user hand grip units and the end portions of said flexible elongated structures away from the inoperative positions thereof into desired extended positions and to resiliently return said user hand grip units to the inoperative positions thereof when no longer moved by the user.

2. An exerciser as defined in claim 1, wherein each of said first and second upper pulley members has an upper stop structure extending across a peripheral portion thereof and each of said lower pulley members has a lower stop structure extending across a peripheral portion thereof, said first and second flexible elongated structures include first and second flexible elongated non-extensible elements trained around said lower pulley members so as to provide said first and second outwardly extending end portions respectively, each of said first and second non-extensible elements having a stop element fixed to the end portion thereof constructed and arranged to interengage with said lower stop structure to determine the inoperative position of said end portions of said first and second moving assemblies respectively said bungee cords including:

a first and second series of resiliently extensible bungee cords associated with said first and second moving assemblies respectively, said first and second series of bungee cords including first and second upper end portions respectively trained around first and second upper pulley members and having hook connectors fixed on terminal ends of said first and second upper end portion constructed and arranged to be selectively engaged with first and second connecting terminal on adjacent ends of an associated non-extensible element or in the associated upper stop structure whereby the number of hook connectors connected to each connecting terminal determines the number of bungee cords resisting movement of the corresponding moving structure away from the inoperative position thereof.

3. An exerciser according to claim 2, wherein each bungee cord includes a lower end portion fixed to said frame assembly.

4. The exerciser of claim 3, wherein each first and second series of bungee cords includes three bungee cords each providing a different resilient resistance whereby the total resistance provided with respect to any moving assembly can be varied by virtue of a selection of any one, any two or all three bungee cord hook members to be connected to the associated connecting terminal.

5. The exerciser of claim 4, wherein said connecting terminal comprises a ring-like member.

6. An exerciser as defined in claim 5, wherein said first and second end sections have first and second looped end portions constructed and arranged to connect with said first and second hand grip units respectively and first and second stop elements respectively fixed thereon in spaced relation to the looped end portions thereof, said first and second stop elements cooperating with the lower stop structure of said lower pulley members to determine the inoperative positions of said first and second moving assemblies.

7. An exerciser as defined in claim 6, wherein said first and second end sections include first and second intermediate loops respectively between associated stop elements and looped end portions thereof, said intermediate loops being constructed and arranged to selectively receive said first and second hand grip units respectively in connected relation thereto.

8. An exerciser as defined in claim 7, wherein said user support assembly includes:

a user seat member;

a user seat back member;

an elongated support member having one end connected to said upright frame assembly and extending in an operative position generally horizontally outwardly therefrom;

an outer leg structure constructed and arranged to engage and be supported on the horizontal surface in spaced relation to said frame extending in an operative position in supporting relation with respect to said elongated support member to maintain the elongated support member in said generally horizontally outwardly extending relation from said lower frame portion;

seat back mounting structure disposed in supporting relation to said seat back member constructed and arranged to be fixedly disposed in an upright position extending generally inwardly in inclined relation to said user seat member.

9. An exerciser as defined in claim 8, wherein said outer leg structure is fixed to an outer end of said elongated support member.

10. An exerciser as defined in claim 9, wherein said seat back mounting structure includes a pivoted support frame unit supporting said user seat back member pivotally connected to a pivoted strut frame pivotally connected between said pivoted support frame unit and said elongated support member.

11. An exerciser as defined in claim 10, wherein said lower frame portion has a pair of horizontally spaced rollers rotatably mounted thereon for rotation about a horizontal axis in a position to facilitate the transport of said exerciser to different locations of use by tilting said upright frame assembly in a direction opposed to the direction of the outer leg structure.

12. An exerciser as defined in claim 11, wherein said first and second end sections include first and second intermediate loops respectively between associated stop elements and looped end portions thereof, said intermediate loops being constructed and arranged to selectively receive said first and second hand grip units respectively in connected relation thereto.

13. An exerciser comprising:

a frame assembly including a lower frame portion constructed and arranged to be stablely supported in an operative position on a horizontal surface and left and right rigid upright support members fixed at lower end portions thereof on said lower frame portion and extending upwardly from said lower frame portion when in the operative position thereof;

a user support assembly operatively connected with said frame assembly and constructed and arranged to support a user thereon;

an exercising system carried by said frame assembly and constructed and arranged to enable a user supported on said user support assembly to perform arm exercises with either or both arms;

said left and right rigid upright support members having integral laterally spaced left and right upper free ends disposed above said lower frame portion in outwardly diverging relation with respect to one another, said exercising system including (1) left and right pulleys mounted on the left and right free ends of said left and right upright support members respectively (2) elongated structures, some of which are trained over said left and right pulleys and (3) left and right hand grips constructed and arranged to be gripped by both hands of a user and to be moved individually or simultaneously through exercising strokes, said elongated structures including left and right flexible non-extendable elongated structures connected to said left and right hand grips respectively for movement through operative strokes in response to the exercising strokes of said left and right band grips by the user, and resiliently extensible and retractable elongated structures constructed and arranged to (1) resiliently extend so as to provide yielding resistance to the operative strokes of said flexible non-extensible elongated elements and the exercising strokes of said hand grips by the user and (2) resiliently retract so as to provide return strokes for said flexible non-extensible elongated elements and said hand grips after the operative and exercising strokes thereof.

14. An exerciser as defined in claim 13, left and right free ends on which said left and right pulleys are mounted forming parts of left and right free end portions, respectively, which are configured to curve upwardly from the lower end portions of said left and right rigid upright support members fixed on said lower frame portion.

15. An exerciser as defined in claim 14, wherein said resilient extensible and retractable elongated structures are elongated resilient bungee cards and constitute the elongated structures trained over said left and right pulleys.

16. An exerciser as defined in claim 15, wherein said left and right flexible non-extensive elongated structures are (1) connected bungee cords constituting the left and right elongated structures trained over said left and right pulleys respectively and (2) trained about left right lower pulleys mounted on said frame assembly below the left and right pulleys mounted on the left and right free ends of said left and right upright support members.

17. An exerciser comprising:

a frame assembly including a lower frame portion constructed and arranged to be stablely supported in an operative position on a horizontal surface and left and right rigid upright support members fixed at lower end portions thereof on said lower frame portion and extending upwardly from said lower frame portion when in the operative position thereof;

a user support assembly operatively connected with said lower frame portion constructed and arranged to support a user thereon;

said left and right rigid upright support members having integral laterally spaced left and right upper free ends disposed above said lower frame portion in outwardly diverging relation with respect to one another, and left and right exercising assembles on said frame assembly constructed and arranged to be manually moved through exercising strokes by both hands of a user supported on said user support assembly, said left and right exercising assembles including left and right operative structures carried by said upper free ends of said left and right rigid upright support members, respectively.

18. An exerciser as defined in claim 17, wherein said left and right exercising assembles include left and right hand grips constructed and arranged to be gripped by both hands of a user and to be moved individually simultaneously through exercising strokes.

19. An exerciser as defined in claim 18, wherein said left and right hand grips are operatively connected with a set of elongated extensible and retractable resilient resisting structures.

20. An exerciser as defined in claim 19, further comprising connecting structure enabling any number of said set of elongated resilient resistance structures to be operatively connected to said left and right hand grips.

21. An exerciser as defined in claim 17, wherein said left and right operative structures of said left and right exercising assemblies include (1) left and right pulleys mounted on the left and right free ends of said left and right upright support members respectively and (2) flexible elongated structures trained over said left and right pulleys.

22. An exerciser as defined in claim 17, wherein said left and right free ends on which said left and right pulleys are mounted form parts of left and right free end portions, respectively, which are configured to curve upwardly from the lower end portions of said left and right rigid upright support members fixed on said lower frame portion.

* * * * *